US006503072B2

(12) United States Patent
Nardi

(10) Patent No.: US 6,503,072 B2
(45) Date of Patent: Jan. 7, 2003

(54) PRESSURE ARTICULATED POSITIVE DISPLACEMENT, SINGLE EXPANSION ROTARY ENGINE

(76) Inventor: Anthony P. Nardi, 14 Windsor Blvd., Londonderry, NH (US) 03053

( * ) Notice: Subject to any disclaimer, the term of this patent is extended or adjusted under 35 U.S.C. 154(b) by 0 days.

(21) Appl. No.: 09/854,871

(22) Filed: May 14, 2001

(65) Prior Publication Data

US 2002/0168281 A1 Nov. 14, 2002

(51) Int. Cl.[7] ..... F01C 1/00
(52) U.S. Cl. ..... 418/225
(58) Field of Search ..... 418/225, 227

(56) References Cited

U.S. PATENT DOCUMENTS 181,112 A * 8/1876 Speer ..... 418/225
525,121 A * 8/1894 Shepard ..... 418/225
1,214,981 A * 2/1917 Wikander ..... 418/225
5,039,290 A * 8/1991 Nardi ..... 418/225

* cited by examiner

*Primary Examiner*—John J. Vrablik
(74) *Attorney, Agent, or Firm*—Samuels, Gauthier & Stevens, LLP

(57) ABSTRACT

A positive displacement single expansion steam expander engine. Cylinder heads are fixed to the wall of the engine. A rotatable power shaft assembly has a plurality of nests. Received in each of the nests is a free-floating piston (nonengaged) having lobes which allows free movement of the pistons in the nests.

9 Claims, 12 Drawing Sheets

PRESSURE ARTICULATED POSITIVE DISPLACEMENT, SINGLE EXPANSION ROTARY ENGINE

BACKGROUND OF THE INVENTION

Rotary steam engines are well known in the art. Early constructions may be found in patents to Fisher U.S. Pat. No. 137,065; Shepard U.S. Pat. No. 525,121; Taylor U.S. Pat. No. 597,793; Taylor U.S. Pat. No. 949,605; Gross U.S. Pat. No. 968,653; and Conklin U.S. Pat. No. 1,270,498. See also Plummer U.S. Pat. No. 2,454,006; Farrell U.S. Pat. No. 3,109,382; Eyer U.S. Pat. No. 3,236,187; Nardi U.S. Pat. No. 3,865,5221; Gardiner U.S. Pat. No. 4,393,829 and Nardi U.S. Pat. No. 5,039,290.

In this type of steam engine there is no reciprocating piston. Instead each piston (virtual) is partially confined in an output nesting arrangement and moves continuously in one direction. The inner transverse edge of each piston engages and slides along the cylindrical surface of a stationary inner body (cylinder head). The inner body carries a plurality of rotatable elements/virtual pistons (ordinarily one more than the number of virtual cylinder heads) nested for rotation in a succession of cavities in the inner body.

The rotatable elements/virtual pistons act to form the ends of the curved cylinders. The construction permits the piston on reaching the end of its stroke, to pass the virtual cylinder head to move into the next cylinder.

The radially outermost part of each virtual piston forming the end of the cylinder is in steam tight fixed gap arrangement with the walls of the cylinder.

In order that the piston may pass the virtual cylinder head, it is essential that the piston and the virtual cylinder head be in a form which might be said to be roughly in the nature of paired gear teeth. Thus the piston would represent an internal tooth, designed to cooperate with external teeth on the virtual cylinder head.

In some of the early forms disclosed in the prior art, it was considered desirable to gear the rotating part of the engine to the non-rotatable element in such manner that when the piston reached the rotatable element, the latter would be positively rotated by the gearing so that the piston would enter a complementary cavity in the rotatable element and thus to pass thereby. In other forms in the prior art, the piston came into positive engagement with one of the stationary blades of the rotatable element and forced the blade to rotate, thereby permitting passage of the piston into the next curved cylinder.

In all of the prior constructions, the shape of the piston and the shape of the blades of the rotatable elements did not provide for efficient passage of the piston past the rotatable element. There was a leakage of steam, shock, excessive condensation, undue wear of the engaging portions, inefficiency in the location of the exhaust ports, inefficiency in the performance of the steam admission ports and inability to change the time of steam cut-off.

In my prior invention, U.S. Pat. No. 5,039,290 the outer housing was stationary. The piston was a free floating piston and had no shaft.

Broadly my invention is a positive displacement, single expansion pressure articulated expander, like a turbine i.e., it has no compression cycle. The engine is designed to operate on saturated steam at moderate temperatures and pressures (475° F. and 500 psi). At these temperatures, a 5% mixture of lubricating oil can, if desired (but not necessarily) be admitted to the steam directly. In general terms, the engine can be classified as a positive displacement turbine.

A steam turbine's longevity (20 years) is based on 100% fixed gap clearance; i.e., no metal to metal contact. The present invention has a fixed gap clearance of about 80%. The remaining components are pressure balanced which minimizes metal to metal contact.

The engine of the preferred embodiment has a high power/weight ratio (2 lbs./HP least admission, 0.5 lbs./HP full admission). It is equivalent to a 12 cylinder internal combustion engine because there are 6 power strokes per revolution. Furthermore, it has a wide power range—0.05–1 megawatt and the possibility of 40% thermal efficiency.

In the present invention, cylinder heads are fixed to the outer stationary wall of the engine. The inner edge of each cylinder head has a fixed gap through which slides the cylindrical surface of a rotatable power shaft assembly, which shaft assembly has a plurality of nests. Received in each of the nests is a virtual piston having lobes which allow free movement of the pistons in the nests. Adjacent lobes define troughs. The outer edges of the troughs are in sliding engagement with the inner surface of the nest and there is a small fixed gap 0.0015" clearance with the inner surface of the fixed outer wall of the engine. Further, the outer surfaces of the lobes cooperate closely with the outer surfaces of the cylinder heads. Thus, the major portion of each piston has substantially the reverse configuration of the walls of the cylinder head. However, the design is such that an acceleration/deceleration ramp can be accomplished by initiator and admission cycles.

The virtual piston within the nest is balanced at all times (except when in contact with the cylinder head). Specifically, the cylinder head vertex effectively reduces the area on the face of contact about its axis of rotation within the nest but is imbalanced with reference to the center of rotation of the dual-nested power shaft assembly. Upstream of the cylinder head is an exhaust port. As the facing surface of a first lobe approaches the exhaust port, a chamber is defined by the inner surfaces of the stationary walls, the surface of the cylinder head opposing the facing surface of the lobe, the outer surface of the power transfer shaft and the surface of the lobe next preceding the first lobe. As the first lobe passes the exhaust port, the exhausting ceases and virtual piston (VP) acceleration is applied by an initiator. The shaft assembly continues to rotate in a counterclockwise direction, while clockwise rotation is imparted to the virtual piston by the initiator. As rotation continues, the first lobe engages the opposed surface of the cylinder head.

The shaft assembly continues to rotate in the counterclockwise direction. The virtual piston always rotates in the clockwise direction. A new volume is defined on the other side of the cylinder head between the surface of the next preceding lobe facing the opposed cylinder head surface, and the facing surface of the first lobe. Steam is introduced from the cylinder head into this volume tending to drive the free piston in a counterclockwise direction. The piston is unbalanced but cannot rotate in a counterclockwise direction because it is prevented from doing so at this time by contact with the vertex of the cylinder head and the large side roller. The force created by the introduction and expansion of the steam in the closed chamber continues to drive the shaft assembly in the same direction (ccw).

In the preferred embodiment, there are three cylinder heads spaced 120° apart and two virtual pistons spaced 180° apart. Thus, there is always at least one steam cylinder in operation and there never will be any position of dead center.

As a result, the rotation of the inner shaft assembly is continuous and the driving force provided by this stream is substantially uniform.

DESCRIPTION OF THE PREFERRED EMBODIMENT(S)

Figure 1:
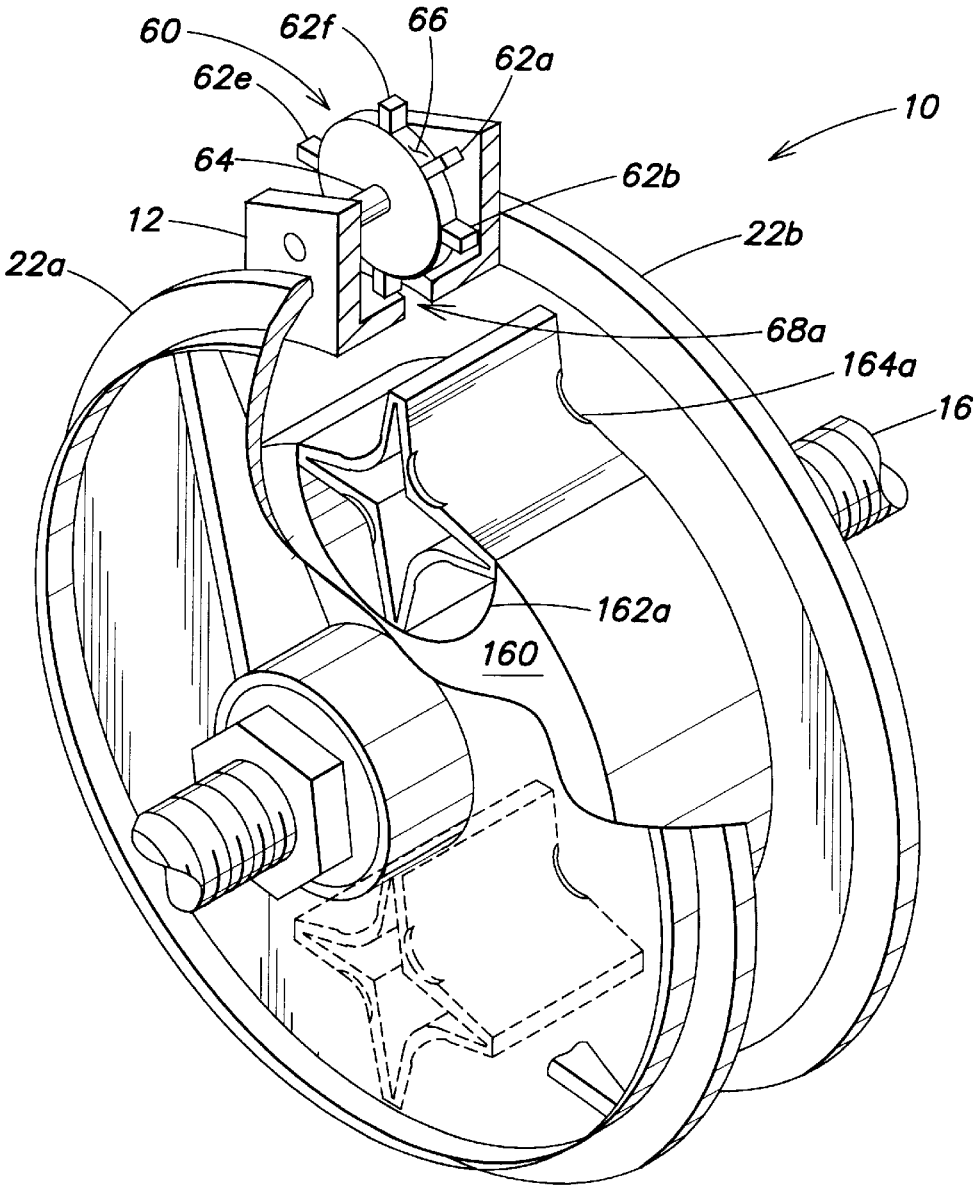
FIG. 1 is a perspective broken away view of an engine embodying the invention.
Figure 3:
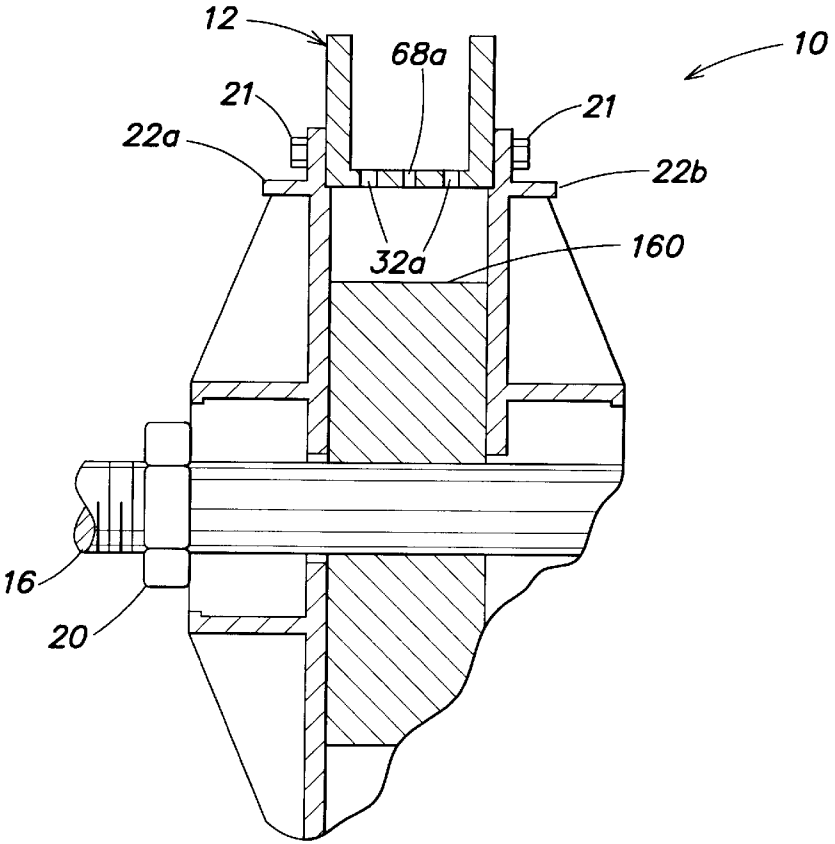
FIG. 3 is a side partly sectional view of the engine.
Figure 2:
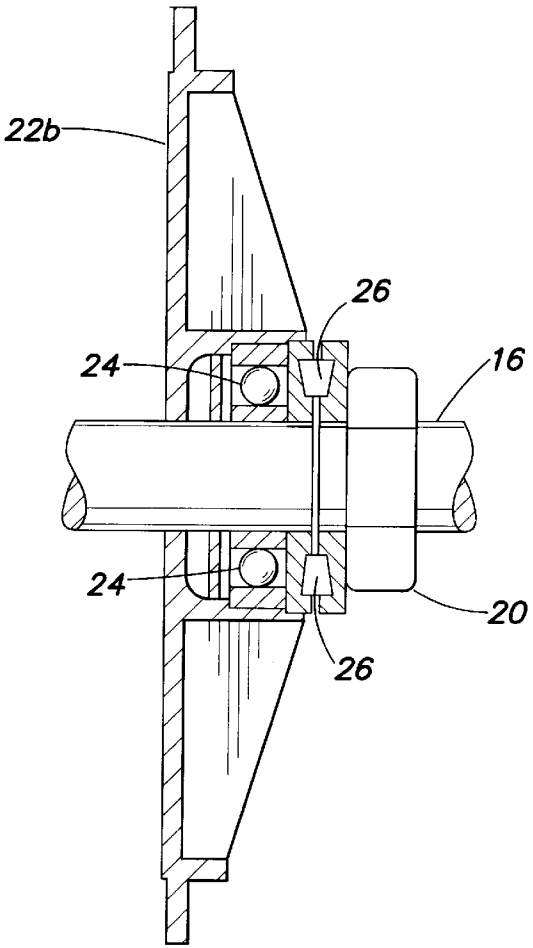
FIG. 2 is a sectional view of a bearing assembly.

Referring to FIGS. 1, 2 and 3, an engine is shown generally at 10 and comprises a sleeve 12 fixedly secured to a base (not shown) in any suitable manner. A tubular power shaft 16 is supported by two opposed ball and thrust roller bearing assemblies and securing nuts 20 (only one shown). Opposed face plates 22a and 22b are received over the power shaft 16 and carried on bearings 24. The sleeve 12 is secured between the face plates 22. The face plates 22 and sleeve 12 are bolted together in a fluid tight manner by bolts 21 and secured against axial and rotatable movement by the nuts 20 on the shaft 16. The shaft 16 is supported by ball bearings 24 and thrust bearings 26 abut the outer face of each face plate 22.

Figure 4:
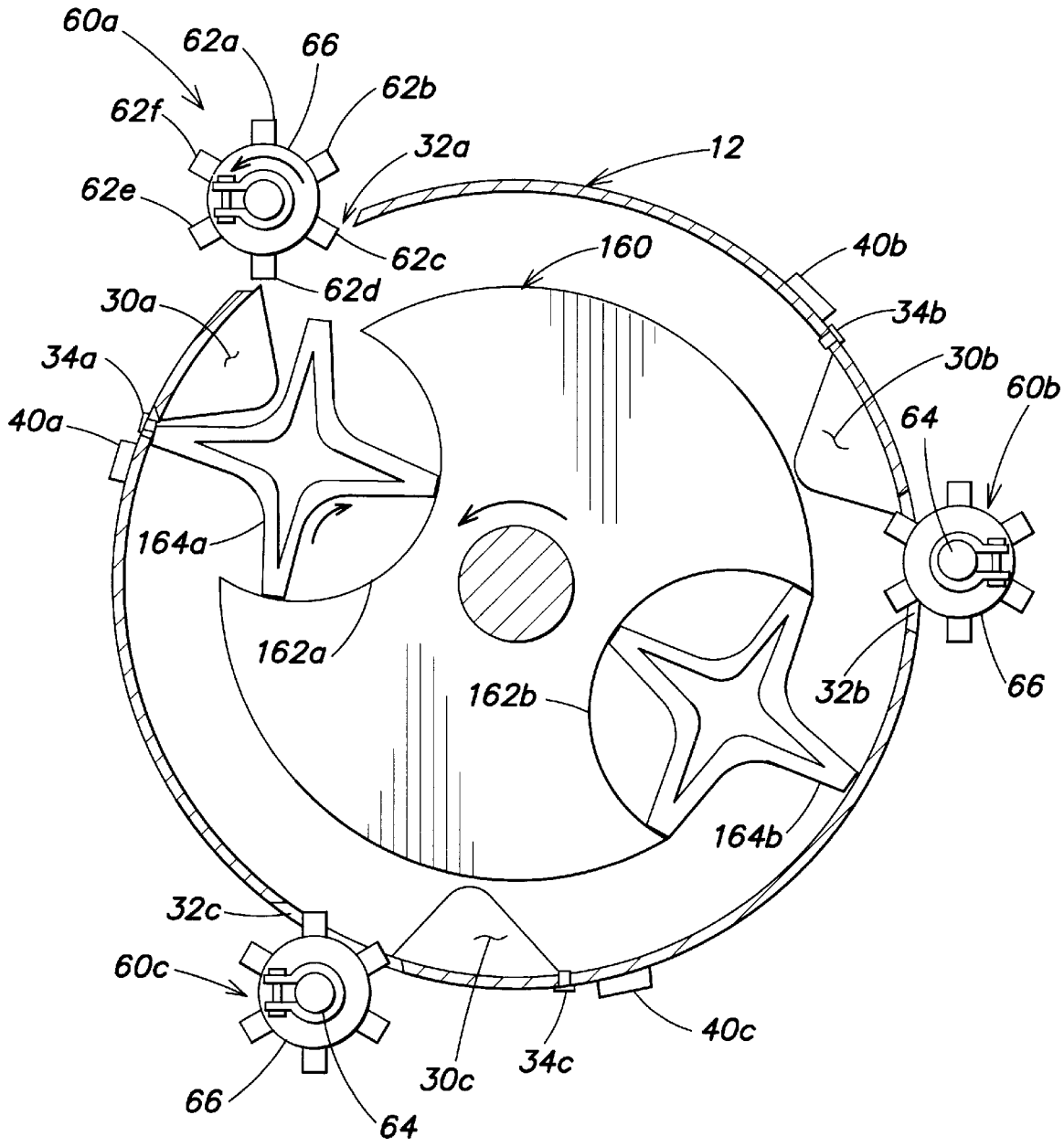
FIG. 4 is a front schematic view of the engine.

Referring to FIG. 4, secured to the inner surface of the sleeve 12 are cylinder heads 30*a*, 30*b* and 30*c* spaced 120° apart. Upstream of the cylinder heads 30 are paired exhaust ports 32*a*, 32*b* and 32*c*. Secured to the outer surface of the sleeve 12 are three initiators 60*a*, 60*b* and 60*c*, 120° C. apart. Each initiator 60 has six lobes, 62*a*–62*f*, spaced 60° apart.

Referring to FIGS. 1 and 4, the initiator 60 is a wheel-like structure secured to an idle shaft 64 having a brake assembly 66 surrounding the idle shaft 64. The sleeve 12 is characterized by three slots spaced 120° apart, only 68*a* is shown in FIG. 3. The lobes 62 are in registration with the slots 68 and are adapted to engage the tip of a virtual piston as will be described. Just downstream of each cylinder head 30, with reference to the direction of an assembly 160, is an associated contact switch, 34*a*, 34*b* and 34*c*. For each cylinder head 30/contact switch 34, there is an associated timing circuit 40*a*, 40*b* and 40*c*.

Figure 5:
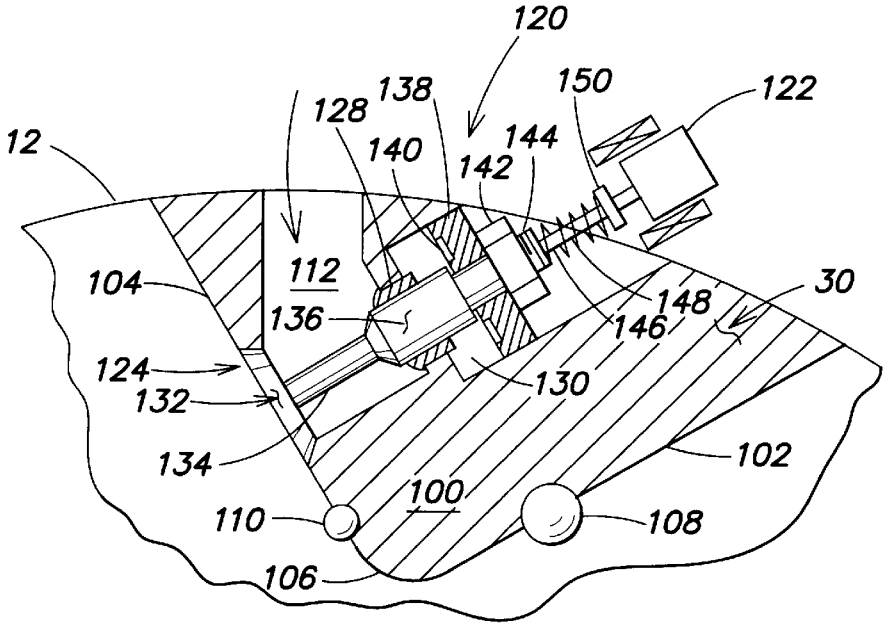
FIG. 5 is a side sectional view of a cylinder head.
Figure 6:
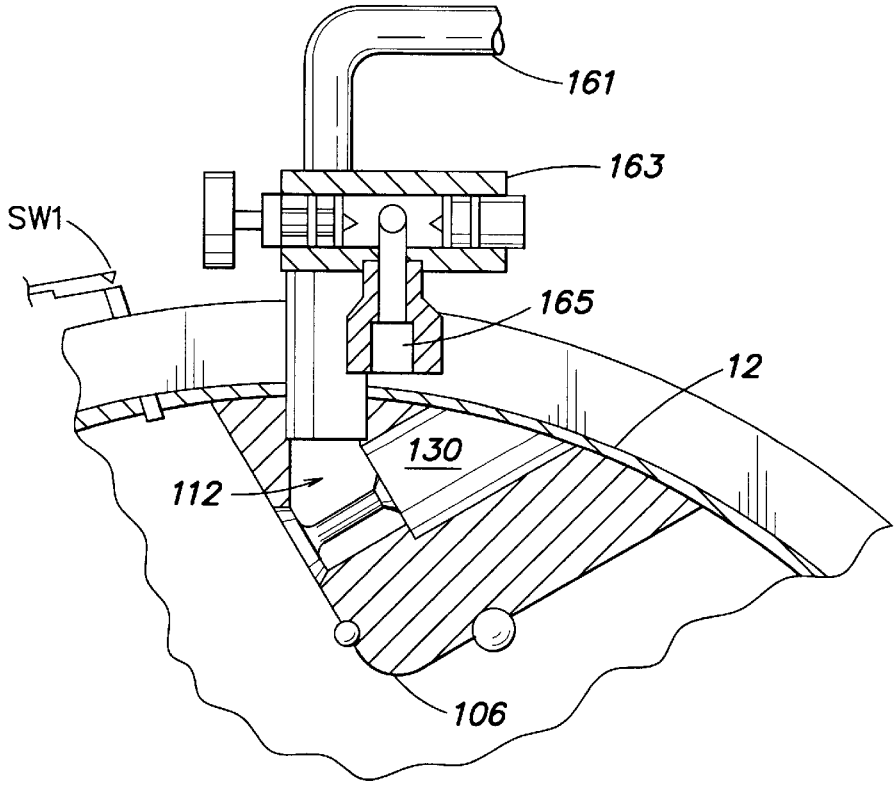
FIG. 6 is a schematic view of a cylinder head with steam feed.

In that the cylinder heads are identical, only one will be described in detail. Referring to FIGS. 5 and 6, the cylinder head comprises a V-shaped body 100, when viewed in cross section, having sloped surfaces 102 and 104 joined at a convex vertex 106. Received on each of the surfaces are rollers, a first larger roller 108 and a second smaller roller 110. To secure the cylinder head to the inner surface of the sleeve 12, it is bolted (bolts not shown).

A steam chamber 112 is defined in the cylinder head 30 and a valve assembly 120 extends into the chamber 112. The valve assembly 120 is actuated mainly by a piloted valve chamber 130 and steam cutoff. A linear solenoid 122 is fixed to a suitable support. The valve assembly 120 seals an opening 124 in the cylinder head 30, which opening 124 allows communication between the steam chamber 112 and the virtual piston as will be described.

The valve assembly 120 is fitted in machined bores 112 and 130 and a bushing 128 guides the valve stem 136. The chamber 130 (there is always steam in bore 112) when pressurized holds the valve closed.

The valve assembly 120 comprises a valve 132, a valve stem 134, sliding stem 136, a pilot valve piston 138 having a clearance recess 140, a nut 142, joined to a threaded end 144 of the sliding steam 136, a solenoid shaft 146, a spring 148 and a retaining ring 150.

Referring to FIG. 6, switch SW #1 and the cylinder head 30 is shown. A steam line 161 provides steam to the main steam chamber 112. A pilot valve (rotary solenoid) 163 controls the flow of steam to the chamber 130 via the line 165. The steam in the chamber 130 is pressurized to cut off steam to the engine and vented for admission of stream to the engine.

The spring 148 biases the valve to an open position. However, the pressure of the steam in the chamber 130 acts against the valve piston 138 and maintains the valve 132 seated. When the pilot valve 163 is actuated, the pilot valve chamber 130 is vented to ambient and the spring 148 and the solenoid 122 moves the valve 132 to its open position.

Referring to FIGS. 1 and 4, the cylindrical dual-nested assembly 160 is staked to the power shaft 16. As shown in FIG. 4, there are two identical semicircular nests 162*a* and 162*b*. Received in these nests 162 in floating engagement when the engine is operating, are two virtual pistons 164*a* and 164*b*.

Figure 8:
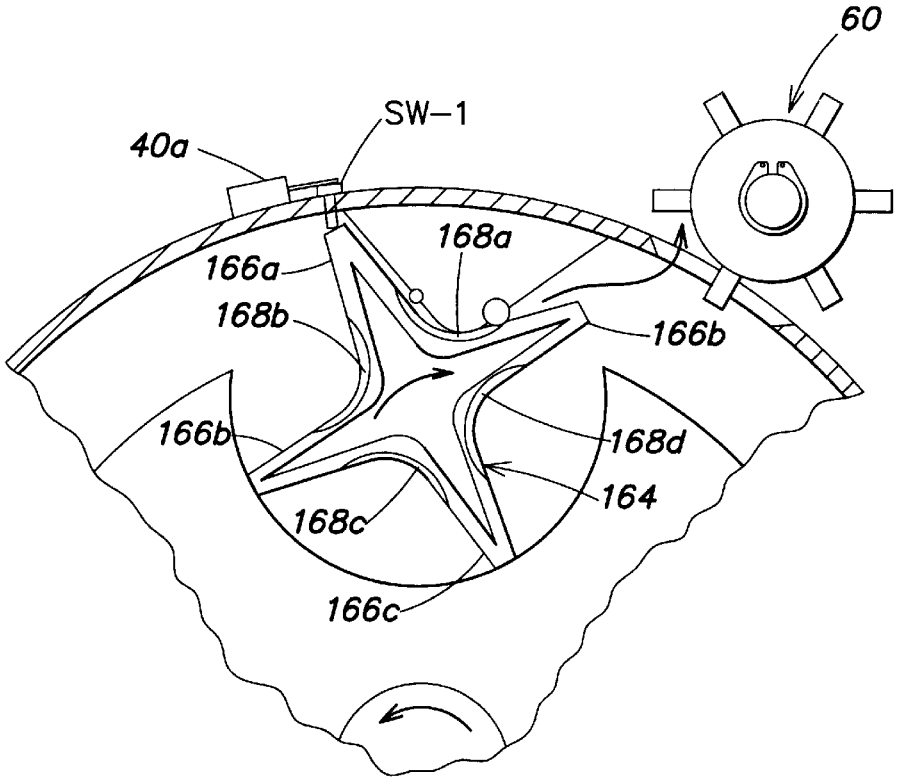
FIG. 8 is an illustration of the mechanical capture while in the imbalance mode of the relationship of a piston within a nest.
Figure 9:
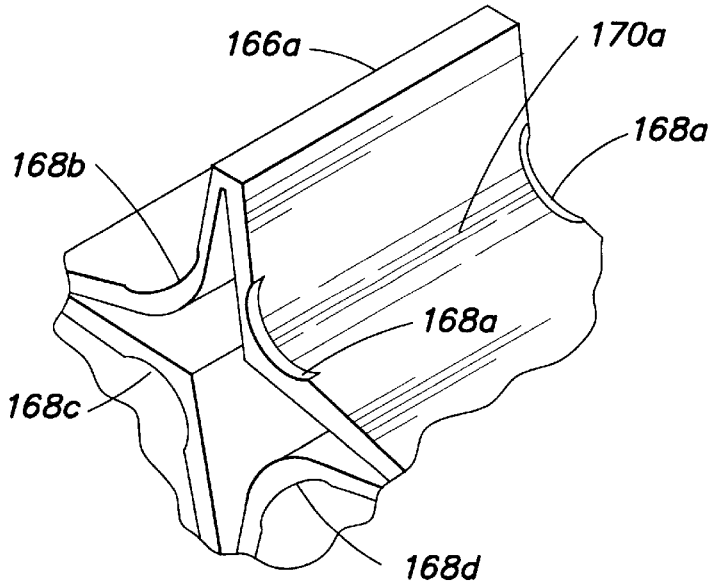
FIG. 9 is a perspective view of a virtual piston.

Referring to FIGS. 8 and 9, each piston 164 has four lobes 166*a*, 166*b*, 166*c* and 166*d*. The lobes 166 are dimensioned to ensure rolling contact with the inner surfaces of the nests 162. The side rollers 108/110 are recessed in the cylinder heads and are flush with the virtual pistons 164 and the opposed facing surfaces of the face plates 22. Referring to FIGS. 8 and 9, the side edges of each of the adjacent lobes 166 are characterized by cusps 168*d*/168*a* which are formed in troughs 170*d*/170*a*. The rollers 108/110 engage the cusps 168.

The power take off is the shaft 16 keyed to the cylindrical dual-nested assembly 160 carrying the two, four-lobed virtual pistons 164. Each virtual piston 164 in sequence has accelerated/decelerated motion only when in the vicinity of the cylinder heads. The acceleration/deceleration action forms the closed volumes necessary for the working steam.

Figure 7:
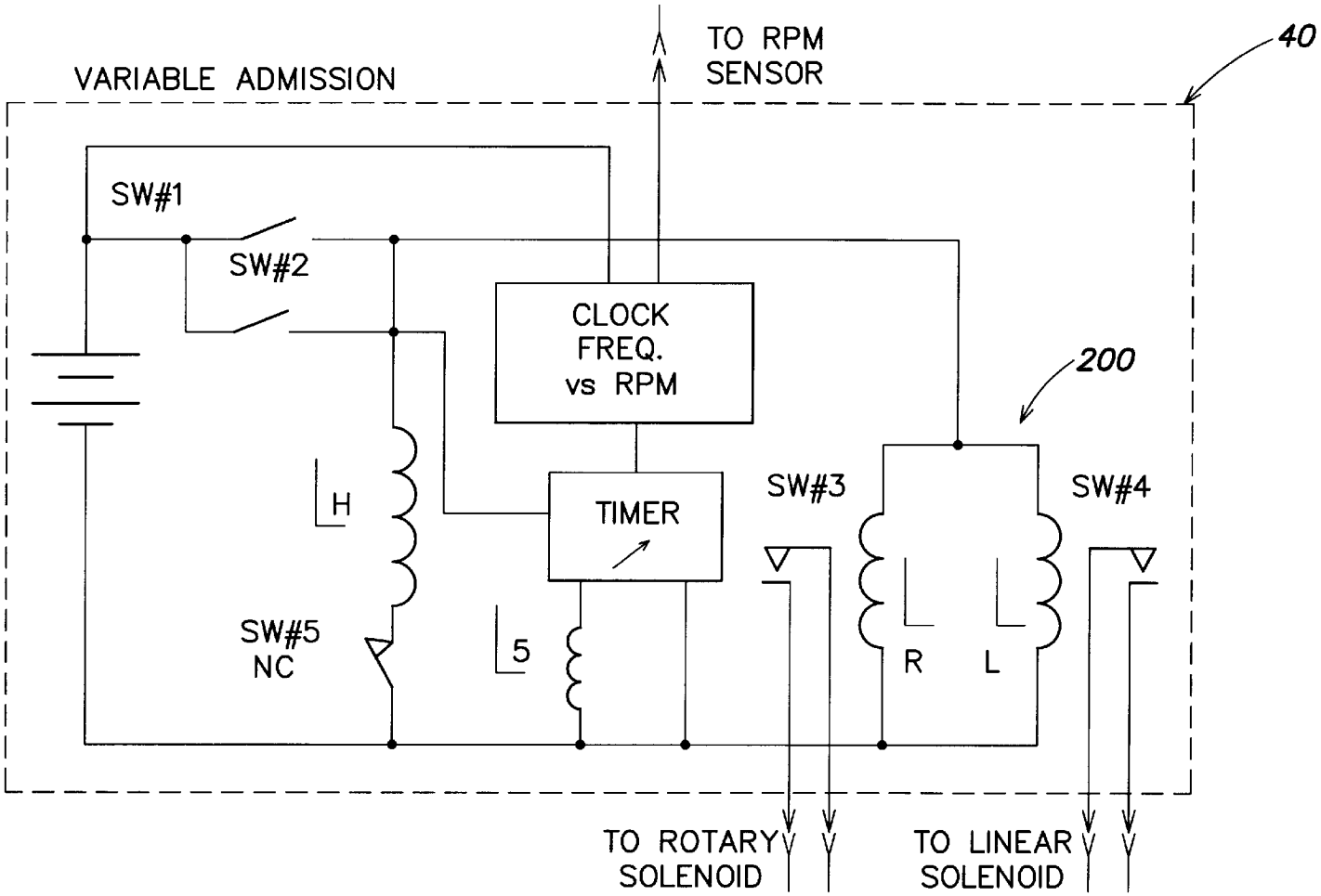
FIG. 7 is a schematic of the timing circuit.

Referring to FIGS. 7 and 8, SW #1 communicates with circuit 40. Steam admission initiates in the cylinder head 30 when the tip of a virtual piston 164 pushes SW #1 radially outward. SW #1 closes momentarily and sets holding contacts SW #2. Variable timer/variable steam admission starts. Switches SW #3 and SW #4 have previously closed through an anticipatory circuit 200 which provides for the linear solenoid 122 and rotary solenoid 163 delay. The rotary solenoid 163 turns 90 degrees clockwise venting the pilot valve chamber 130 and closes the steam supply to the pilot valve chamber 130. The linear solenoid 122 can then overcome the spring 148 and steam discharges into the cylinder head. At timer completion, switch SW #5 (holding contacts) opens momentarily and SW #2, SW #3 and SW #4 all open until the next cycle. There is no delay on SW #3 and SW #4 at open circuit. Clock frequency, a linear function of RPM, maintains expansion proportionality. The location of SW #1 is such that virtual piston tangential velocity is nearly zero. This is the result of the clockwise virtual piston rotation captive in the dual-nest which is rotating counter clockwise at the same peripheral velocity but in opposite directions. The virtual piston outward radial movement, likewise, is in the decelerating mode, hence the name.

A constant force is needed at the lobe tip of the virtual piston 164 to initiate clockwise rotation. The initiator 60 provides a constant force. The brake drum 66 provides a force directly proportional to RPM. The controls (not shown) for the brake drum communicate with the RPM sensor referenced in FIG. 7. As the virtual piston 164 approaches the exhaust port 32, the outward tip's velocity is retarded by one of the initiators lobes 62. A clockwise rotation is imparted by this constant force which is a linear function of RPM, it is about equal to the weight of the VP/60 RPM, e.g. a one pound VP would require a one pound initiator force at 60 RPM—at 600 RPM, the initiator force would be 10 pounds. This also prevents metal-to-metal contact between the cylinder head and the piston.

At steam admission, see FIG. 8, a locking of the dual-nest by the virtual piston could occur if a reverse torque was allowed. The upstream roller 108 has a larger diameter than the downstream roller 110 preventing the cylinder head vertex 106 from contacting the virtual piston face. If the cylinder head vertex 106 were to touch the virtual piston 164, the torque arm would be half that of the left as seen by the torque arm reference circle in dotted lines. The virtual piston 164 would become dominant in the reverse direction (CCW) by the larger torque at the left arrow and act as "dutch man" locking the dual-nest from rotation in the proper direction at low RPM.

Figure 10A:
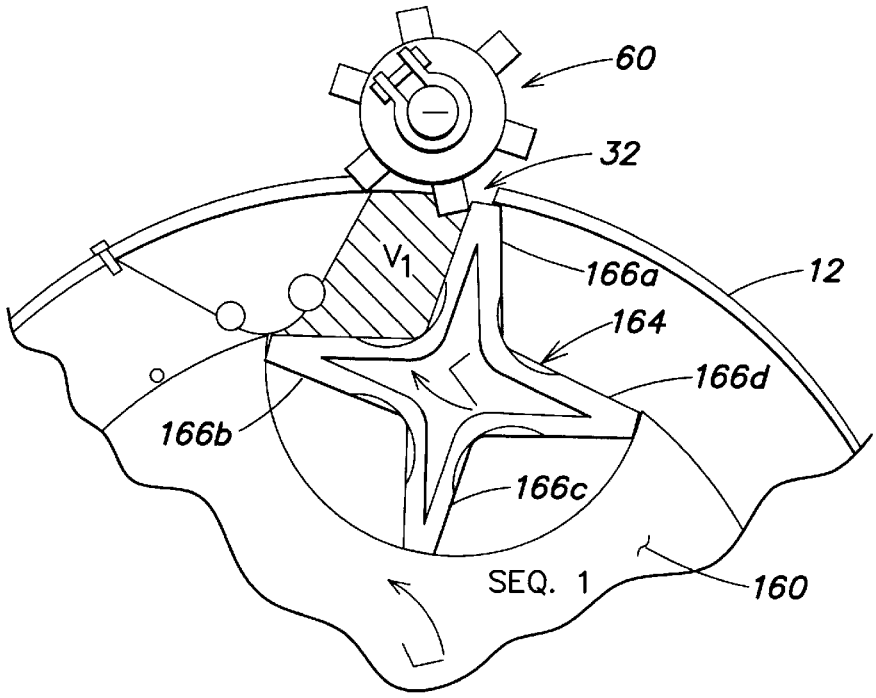
FIGS. 10*a*–10*h* are illustrations of the initiator-exhaust cycles of the engine.
Figure 10B:
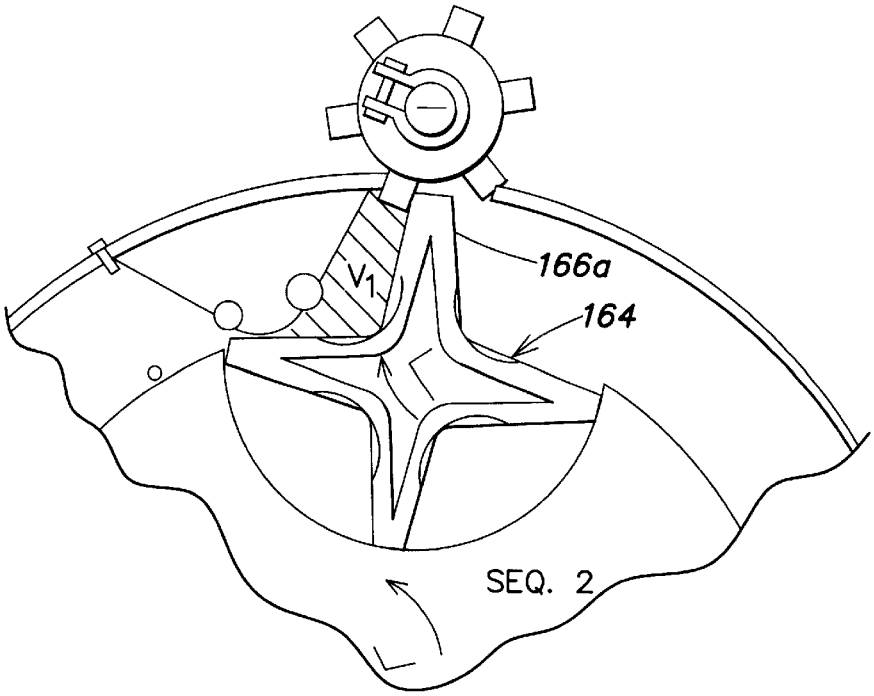
Figure 10C:
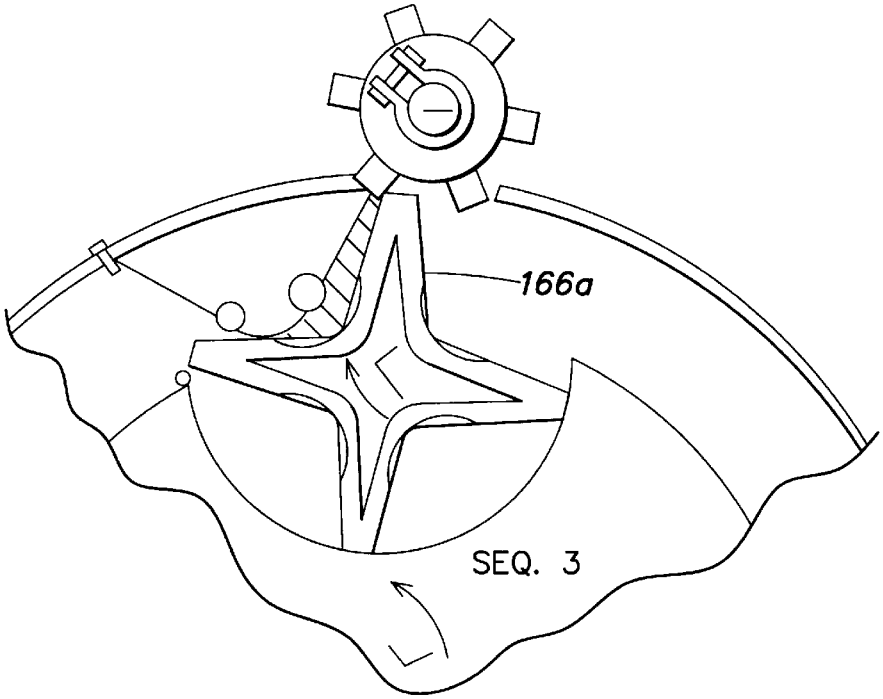
Figure 10D:
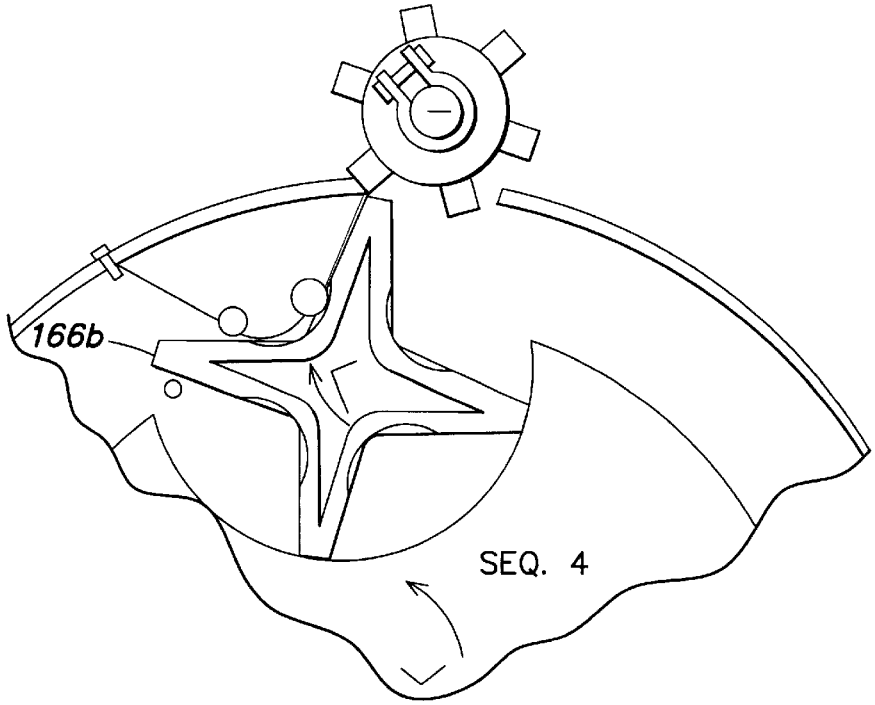
Figure 10E:
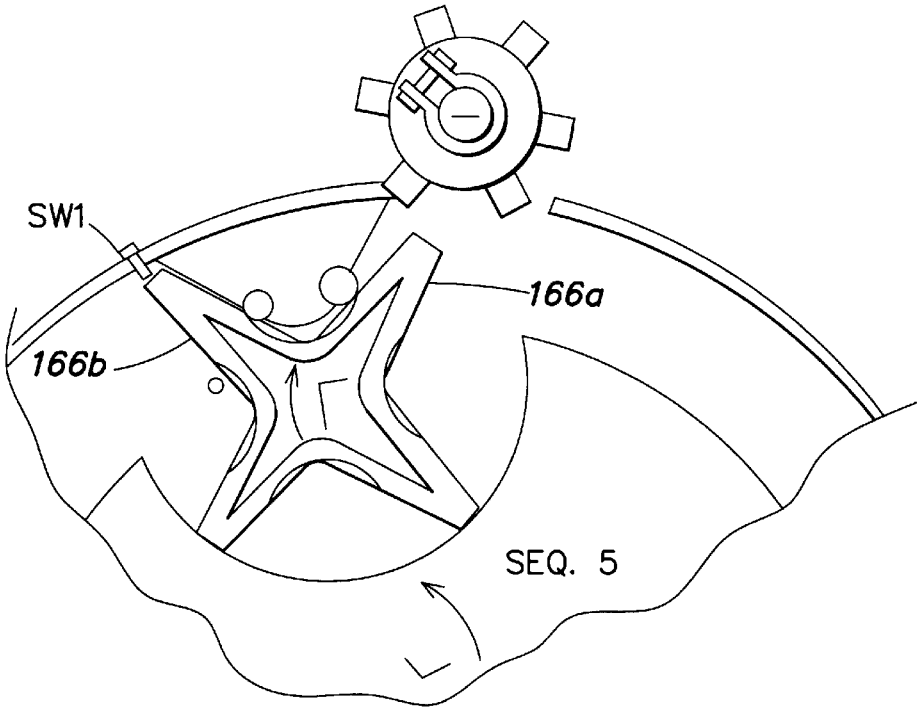
Figure 10F:
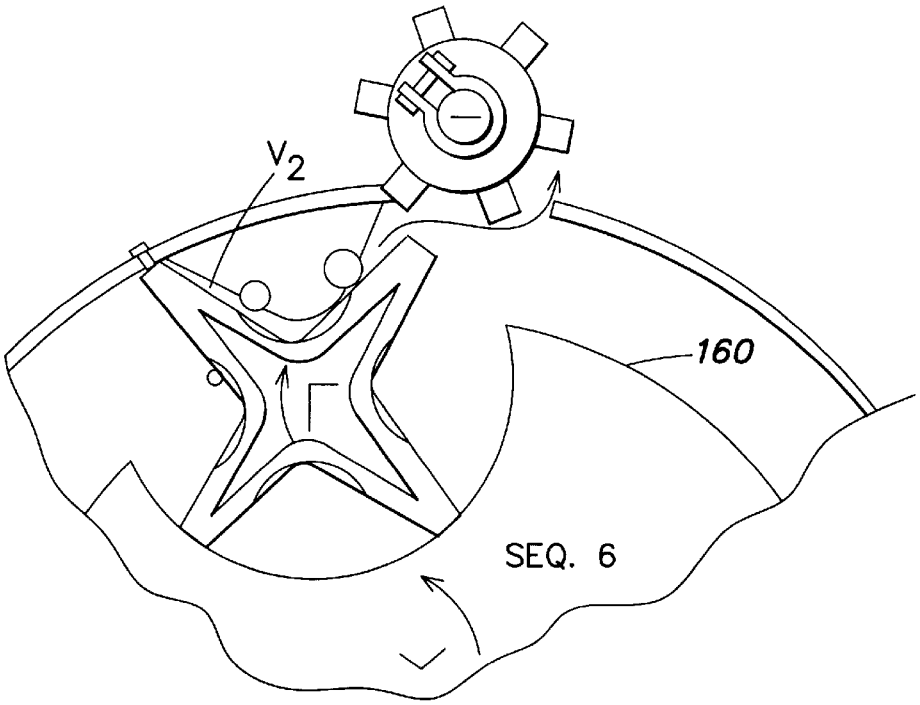
Figure 10G:
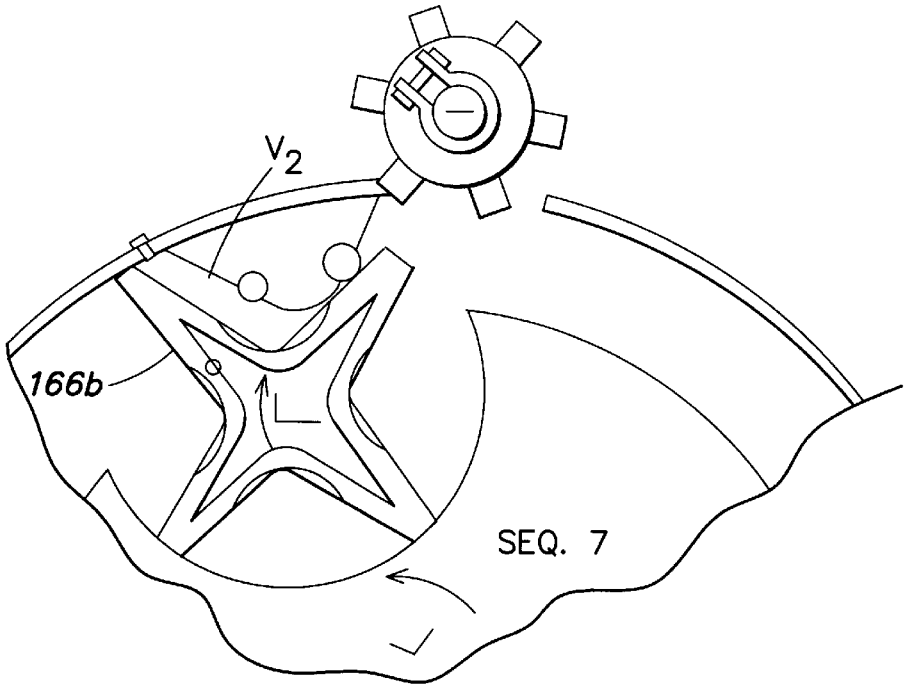
Figure 10H:
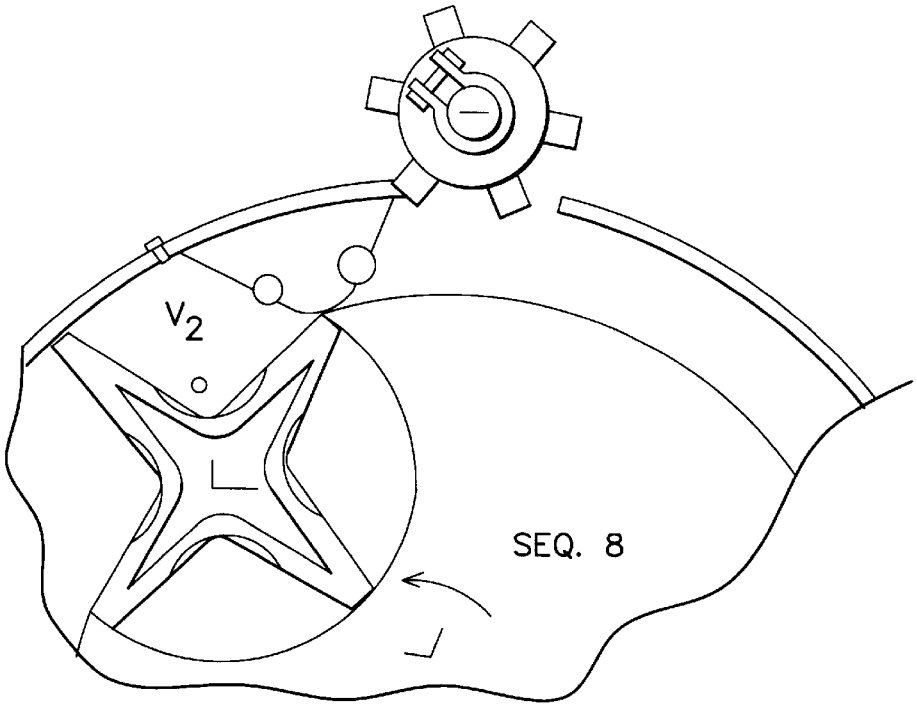

The small transient gap provided the virtual piston cusp 168 also allows condensation to be swept out the exhaust ports 32, see FIG. 10*f*, sequence 6 and FIG. 3. This eliminates condensate rework which results in heavy thermal losses in reciprocating engines called "initial condensation".

Referring to FIG. 10*a* through 10*h*, the virtual piston 164 is in an imbalanced position and includes one lobe 166*a* which rides along the inner surface of the sleeve 12 as the piston approaches the exhaust ports 32. $V_1$ defines a dynamic exhaust volume. The next preceding lobe 166*b* engages the upper surface of the nest and the succeeding lobe 166*d* also engages the upper surface of the nest. The piston 164, at this time, is maintained in this alignment primarily by the initiator 60 force at the lobe tip of virtual piston 164. As the assembly 160 continues in its counterclockwise direction, the volume $V_1$ is defined by the inner surface of the sleeve 12, the surfaces of the lobes 166*a* and 166*b* and the surface of the cylinder head 30 which is opposed to the surface of the lobe 166*a*. As the shaft assembly continues in its counterclockwise movement, FIG. 10*b*, the constant force of the initiator 60 on lobe 166*a* imparts a clockwise rotation to the virtual piston 164. The piston continues in its clockwise rotation as shown.

When the lobe 166*b* engages the inner surface of the sleeve 12 then the surfaces of the lobes 166*b* and 166*a* are opposed to the surfaces of the cylinder head opposed to the surface of the lobe, FIG. 10*e*, and the tip of the lobe 166*b* actuates SW #1. At this time, steam is injected resulting in a retardation of the clockwise movement of the piston and a dynamic power stroke volume $V_2$ is formed, FIG. 10*f*. The force acting on the piston is transferred to the nested assembly 160 as shown in FIG. 10*f*. In addition, the piston within the nest is now approaching balance, FIG. 10*g*. In the balanced power stroke the compressor forces are transferred directly to the shaft assembly. The timing of the injection of the steam is to ensure that before there is any metal contact, steam is admitted for the power stroke. After initiation completion of the power stroke and the alignment shown the piston can enter the phase of FIG. 10*h*.

It is important to note the profile of the virtual piston faces; they are flat and do not conform precisely to a continuance of the dual nest diameter. This configuration allows for acceleration/deceleration to function as a ramp. A further explanation of the principal of the invention follows with reference to FIGS. 11*a* and 11*b*.

The four-lobed virtual piston has no tendency to rotate about its center while it is transmitting a useful force to the dual-nests output power shaft assembly. This balance exists when the piston is not in contact with the cylinder head. Referring to FIG. 11*a*, Pascal's Law states that in a closed volume the pressure everywhere is the same. In the high pressure volume on the right, faces F1 and F2 experience the same pressure. In addition, the areas of the faces F1 and F2 are equal because of the symmetry designed into the piston. Since the force equals pressure times area the force on the face F1 equals the force on the face F2. Although the magnitudes of these forces are equal, their vectors are opposite. That is, the force on face F1 wants to rotate the piston counterclockwise and the force on face F2 wants to rotate the piston clockwise. The same condition exists on the left of the low pressure volume. Therefore, the piston is balanced about its center because of torque cancellation. The force, which results from the differential pressure across the singular, outward pointing lobe of the virtual piston is transmitted through to the dual-nest power output shaft assembly for useful work. The force on the face F1 is greater than the force on the face F3 because of the differential pressure existing across that lobe. Therefore, a torque is present causing the dual-nest assembly to rotate in a counterclockwise direction. There are no equal and opposite forces at the same distance, 180° away, with which to cancel this torque. While a single lobe of the four-lobed piston experiences a differential pressure creating useful torque for the dual-nest assembly, the piston itself does not rotate about its own center.

Figure 11B:
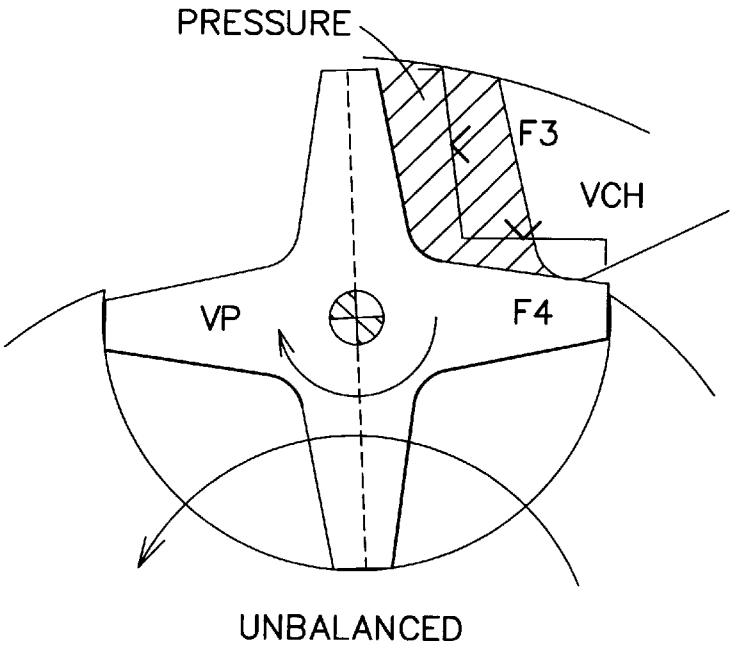
FIGS. 11*a* and 11*b* are illustrations of the balance relationship of the piston within the nest.
Figure 11A:
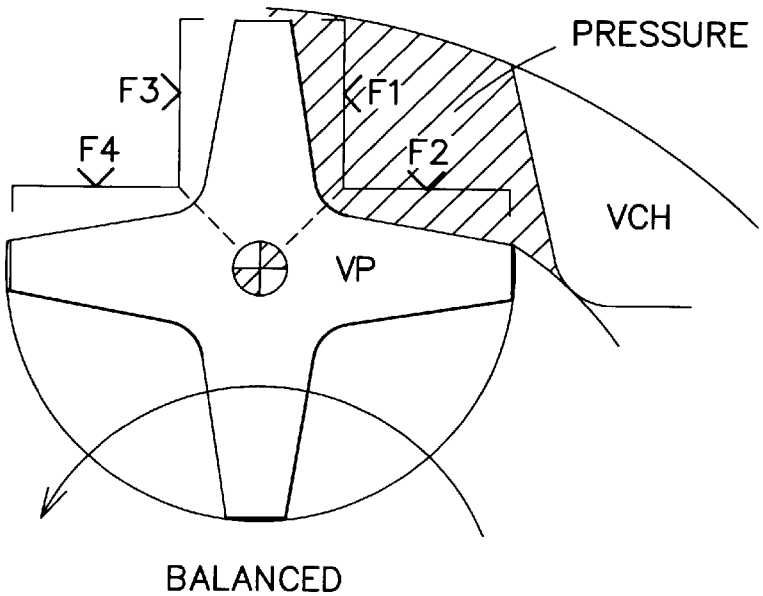

FIG. 11*b* shows the unbalanced mode. The vertex in the cylinder head causes the area defined by $F_4$ in the closed volume to be less that area $F_3$. $F_3$ has not changed. The unbalance of the piston, about its own center, forces $F_4$ face against the roller in the cylinder head. It is important that the piston have no tendency to rotate while out of the engagement vicinity of the virtual cylinder head. Once the piston is in the engagement area of the cylinder head, unbalance occurs which is necessary for the virtual piston's intermittent action. Mechanical capture guarantees piston motion control during the unbalance mode. The mechanical capture is the way the cylinder head and the piston, together with its nest, cooperate to form the closed expansion volumes. The pressure in the forming volumes always tends to keep the cooperating face of the VP against the roller at the vertex of the cylinder head. This is one point of the mechanical capture, see FIG. 11*b*. The other two and then three capture points, in sequence, are the remaining tips of the piston riding in the nest. These are rotatable pedestals or supports for the VP while in the unbalanced mode. The balanced or free piston allows two important functions to occur, namely, shockless acceleration/deceleration by the initiator/admission and high power to weight ratio.

The rotation of the piston 166, about its own center, must be accelerated from zero RPM to a velocity equivalent to that of the engine in a span one-half the diameter of the piston. The deceleration occurs in the other half. A ramp or gradual acceleration/deceleration is required to keep piston turning forces low to avoid shock. The configuration difference between the profile of the cord-like shape of the piston and outer diameter of the dual-nest 160 (shaded area in FIG. 12) allows for this ramp.

Figure 12:
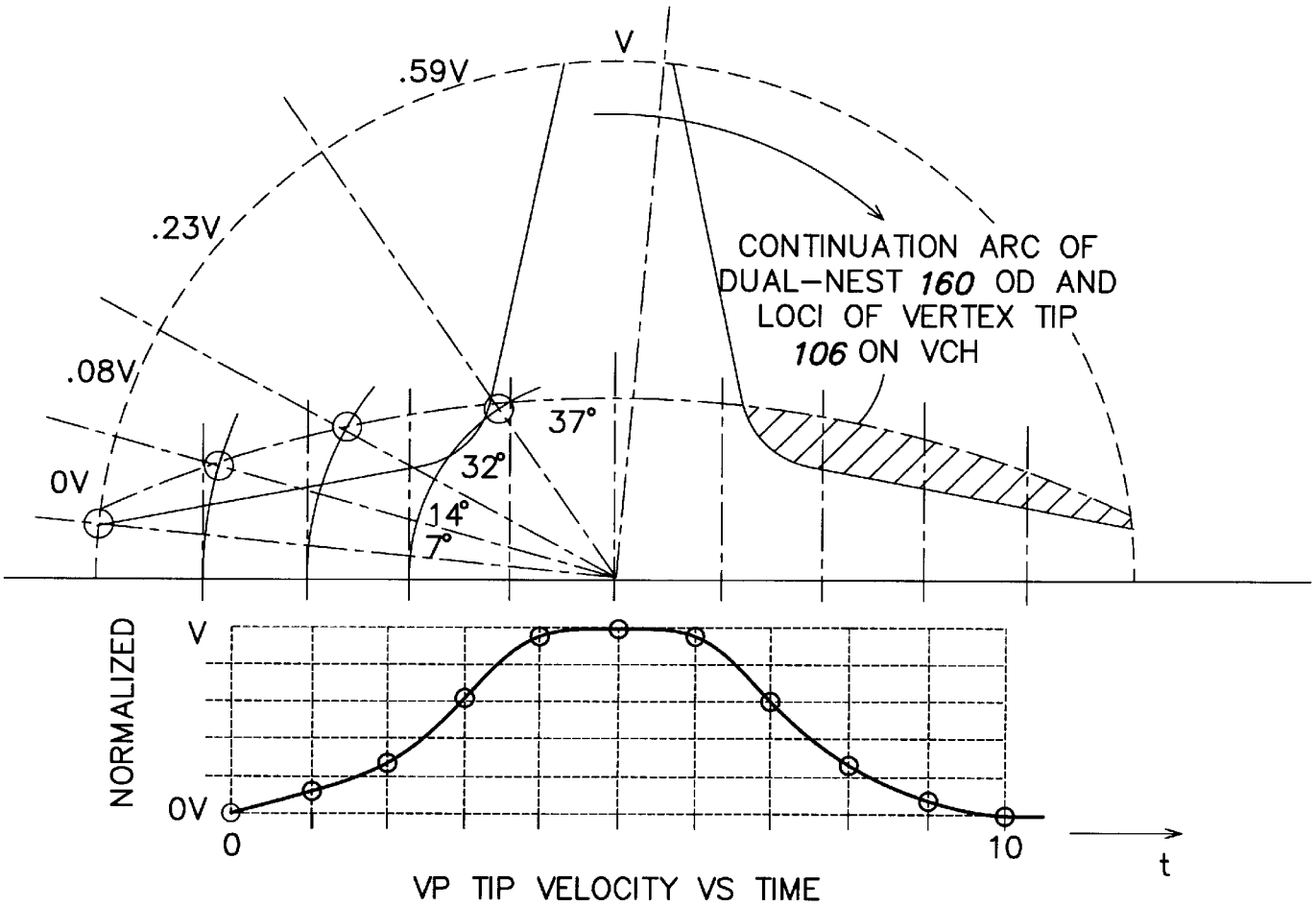
FIG. 12 is a graph illustrating the ramped acceleration/deceleration profile of the virtual piston when in the vicinity of the virtual cylinder head.

Referring to FIG. 12, for illustration, all velocities are given in percentages of V. V is the velocity of the engine; assumed to be constant. A distance equivalent to one diameter of the piston is sectioned into ten equal segments representing equal increments of time. The nine circles on the arc, which is a continuation of the tri-nest outside the diameter, indicate where progressive contact is made by the cooperating face with the vertex 106 of the virtual cylinder head. Although the time segments are equal, it can be seen that the angle changes are not. The angle changes at 7, 14, 32 and 37 degrees start small and get larger and then retreat in reverse order. Time segments 0–2 and 8–10 graph the gradual changes in velocity (acceleration) which provide the ramp for both start and stop action.

The foregoing description has been limited to a specific embodiment of the invention. It will be apparent, however, that variations and modifications can be made to the invention, with the attainment of some or all of the advantages of the invention. Therefore, it is the object of the appended claims to cover all such variations and modifications as come within the true spirit and scope of the invention.

Having described my invention, what I now claim is:

1. A rotary steam engine which comprises:

a stationary sleeve having an inner surface and an outer surface, opposed ends and at least one exhaust port formed in the sleeve;

face plates each joined to an end of the sleeve;

a power shaft rotatably received in the sleeve and extending through one of the face plates the power shaft carrying an assembly in which nests are formed, the assembly adapted to rotate in a forward direction;

cylinder heads having V-shaped walls secured to the inner surfaces of the sleeve, each cylinder head located downstream of an exhaust port with reference to the direction of rotation of the assembly, the cylinder head includes a vertex and the vertex comprises means for maintaining rolling contact with an associated virtual piston for imbalanced contact forces experienced during a ramped acceleration/deceleration sequence;

virtual pistons received in the nests and adapted for movement in balanced and imbalanced modes, the pistons when in the imbalanced mode in free floating engagement in the nests, the pistons having lobes the surfaces of which cooperate with the cylinder walls to define dynamic exhaust volumes and power stroke volumes;

means for imparting a rearward force to the pistons when the pistons are in the imbalanced mode;

means for introducing steam through the cylinder heads and into the power stroke volume in timed sequence to effect a balanced power stroke whereby the force acting on the piston is transformed to the power shaft via the assembly while the piston remains balanced.

2. The engine of claim 1 wherein the cylinder heads and virtual piston and lobes are configured such that the major portion of each piston has substantially a reversed configuration of the walls of the cylinder head.

3. The engine of claim 1 wherein the nested assembly is a dual nested assembly, the nests are equally spaced apart and wherein there are three cylinder heads spaced 120° apart.

4. The engine of claim 1 wherein the sleeve has at least one slot formed therein upstream of a cylinder head and wherein the means for imparting comprises:

an initiator secured to the sleeve, the initiator having a lobe, which passed through the slot, engages a lobe of the piston.

5. The engine of claim 4 wherein the lobe on the initiator is carried on an idle shaft controlled by a brake assembly which assembly is responsive to the RPMs of the engine.

6. The engine of claim 1 which comprises:

means for preventing forward motion of the piston during the balanced power stroke.

7. The engine of claim 6 wherein the means for maintaining rolling contact comprises:

rollers secured to the cylinder head.

8. The engine of claim 7 wherein the lobes of the pistons are characterized by cusps formed in a trough defined by the lobes in which cusps the rollers run.

9. The engine of claim 8 wherein the outer edges of the lobes are in sliding engagement with the inner surfaces of the face plates and there is a defined gap between the tip of a virtual piston lobe and the inner surface of the sleeve.

* * * * *

UNITED STATES PATENT AND TRADEMARK OFFICE

CERTIFICATE OF CORRECTION

PATENT NO. : 6,503,072 B2
DATED : January 7, 2003
INVENTOR(S) : Anthony Nardi

It is certified that error appears in the above-identified patent and that said Letters Patent is hereby corrected as shown below:

Column 3,
Line 2, please delete “stream” and insert therefor -- steam --.

Signed and Sealed this

Eighteenth Day of March, 2003

JAMES E. ROGAN
*Director of the United States Patent and Trademark Office*